US006763940B1

(12) United States Patent
Lai

(10) Patent No.: US 6,763,940 B1
(45) Date of Patent: Jul. 20, 2004

(54) SPORTS BAG

(76) Inventor: Allen Lai, No. 5, Lane 210, Hoping Rd., Tantze Hsiang, Taichung County (TW)

( * ) Notice: Subject to any disclaimer, the term of this patent is extended or adjusted under 35 U.S.C. 154(b) by 22 days.

(21) Appl. No.: 10/338,861

(22) Filed: Jan. 9, 2003

(51) Int. Cl.[7] ..... A45C 5/14; A45C 13/10; A45C 13/36; A63B 55/00; A63B 55/08

(52) U.S. Cl. ..... 206/315.1; 206/315.3; 206/315.4; 206/315.8; 280/DIG. 6; 190/18 A; 190/127; 190/903

(58) Field of Search ..... 190/18 A, 24, 190/127, 903; 206/315.1, 315.3, 315.4, 315.8; 150/159; 280/27.29, DIG. 6

(56) References Cited

U.S. PATENT DOCUMENTS 1,442,906 A * 1/1923 Rawlings et al. ..... 206/315.4
1,618,955 A * 2/1927 Gotisar ..... 206/315.4
2,428,853 A * 10/1947 Procter ..... 280/47.19
3,530,919 A * 9/1970 May ..... 206/315.4
3,901,299 A * 8/1975 Picco ..... 206/315.4
4,249,586 A * 2/1981 Setani ..... 206/315.4
5,265,894 A * 11/1993 Dunn ..... 280/47.26
6,161,698 A * 12/2000 Bradshaw et al. ..... 206/527
6,247,588 B1 * 6/2001 McCreary ..... 206/315.4
6,508,359 B1 * 1/2003 He et al. ..... 206/315.3
6,520,327 B1 * 2/2003 Boardman et al. ..... 206/315.4
6,612,412 B2 * 9/2003 Sanderson et al. ..... 190/18 A
6,634,496 B2 * 10/2003 Scoglio ..... 206/315.3

FOREIGN PATENT DOCUMENTS

JP 2000116831 A * 4/2000 ..... A63B/55/00

* cited by examiner

*Primary Examiner*—Sue A. Weaver
(74) *Attorney, Agent, or Firm*—Rosenberg, Klein & Lee

(57) ABSTRACT

A sports bag is constructed to include a wheeled base frame, a soft bag body fixedly fastened to the wheeled base frame, the bag body having a top opening closed by the wheeled base frame, a bottom opening, a zipper extended from the top opening and the bottom opening, and a carrying handle, and two symmetrical rigid top shells fixedly fastened to the periphery of the top opening of the soft bag body and closed by a zipper.

1 Claim, 4 Drawing Sheets

SPORTS BAG

BACKGROUND OF THE INVENTION

1. Field of the Invention

The present invention relates to bags and, more particularly, to a sports bag, which has a soft bag body well protected by a rigid base frame at the bottom side and two rigid top shells at the top side.

2. Description of the Related Art

Conventional sports bags include tow types, one made from soft material (cloth or leather), and the other made from rigid material. For example, a golf bag is a collapsible soft bag. A soft sports bag cannot well protect the storage items against impact. A rigid sports bag effectively protects the storage item against impact. However, a rigid sports bag is heavy, not convenient to carry.

SUMMARY OF THE INVENTION

The present invention has been accomplished under the circumstances in view. According to one aspect of the present invention, the sports bag comprises a wheeled base frame, a soft bag body fixedly fastened to the wheeled base frame, the bag body having a top opening closed by the wheeled base frame, a bottom opening, a zipper extended from the top opening and the bottom opening, and a carrying handle, and two symmetrical rigid top shells fixedly fastened to the periphery of the top opening of the soft bag body and closed by a zipper. According to another aspect of the present invention, belts are respectively installed in the rigid top shells and tied up to hold the top shells in the closed status.

DETAILED DESCRIPTION OF THE PREFERRED EMBODIMENT

Figure 1:
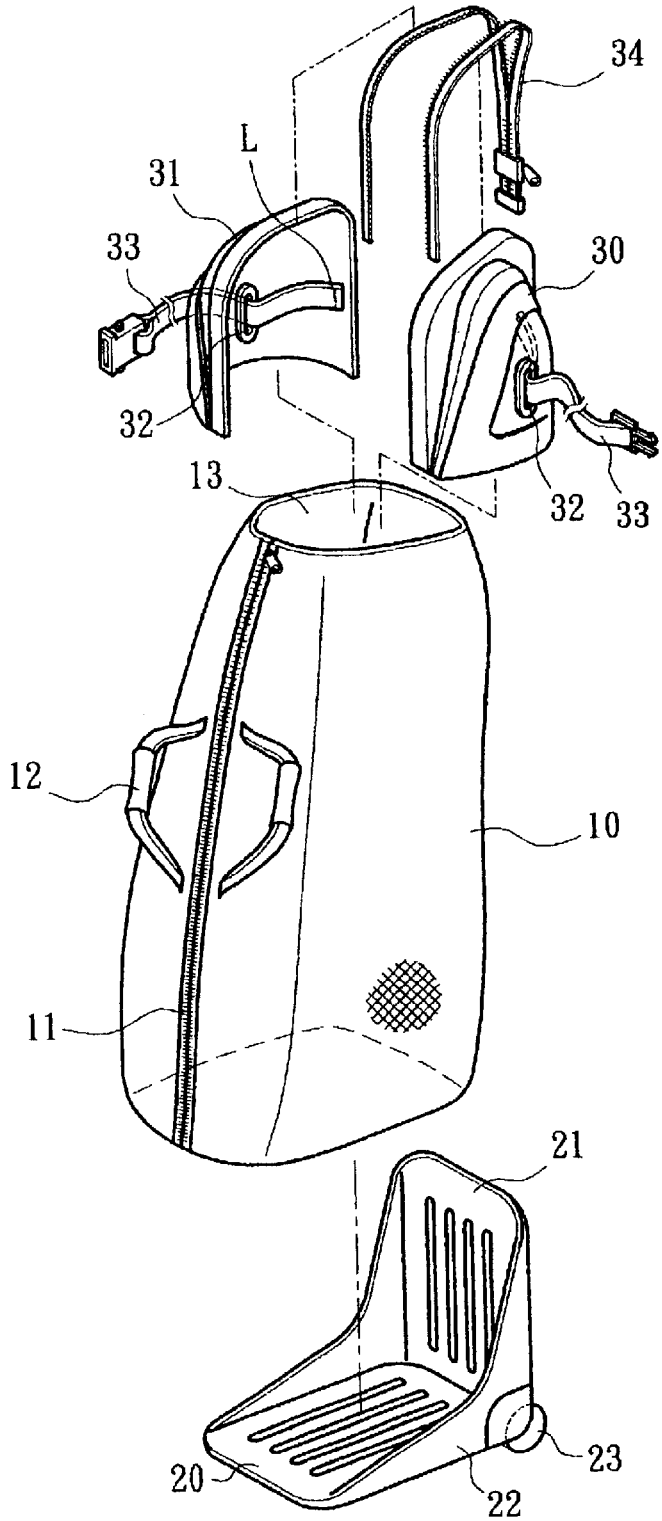
FIG. 1 is an exploded view of a sports bag according to the present invention.
Figure 2:
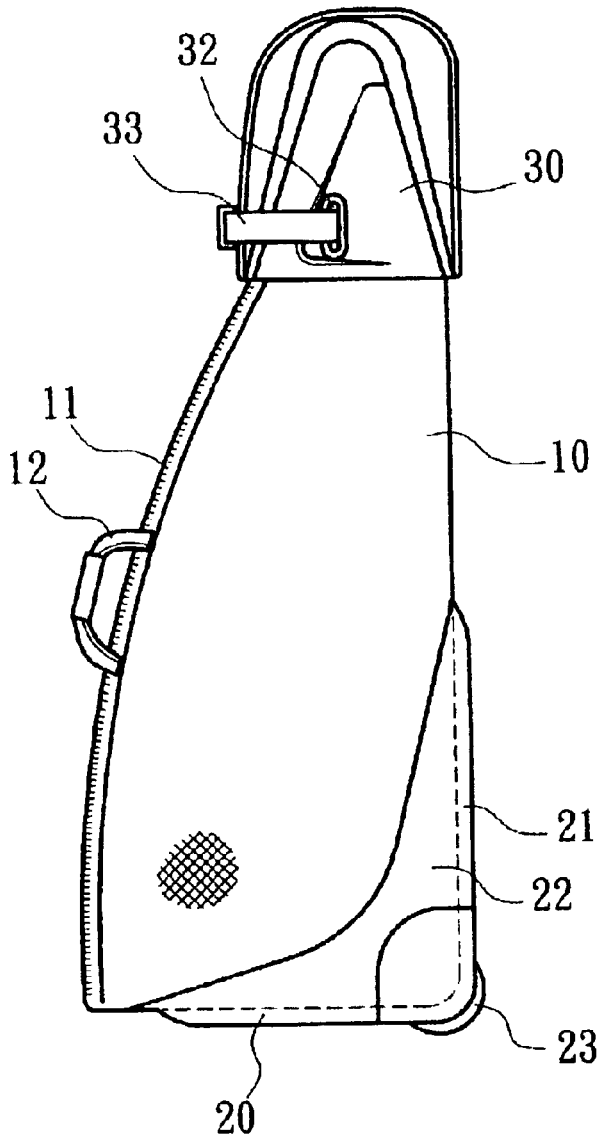
FIG. 2 is a side view of the sports bag according to the present invention.
Figure 3:
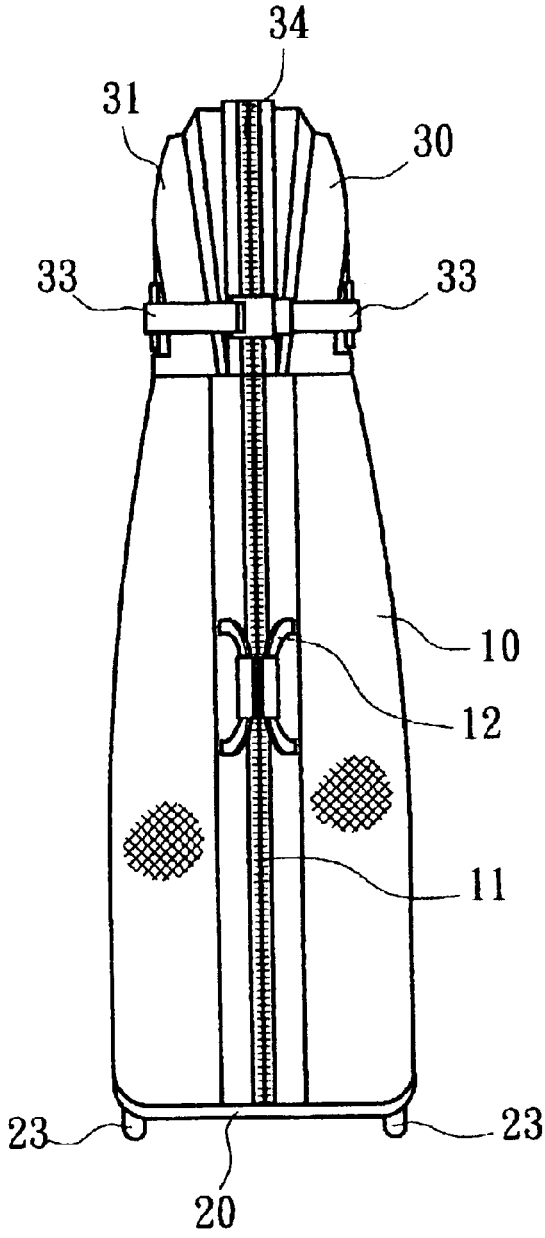
FIG. 3 is a front view of the sports bag according to the present invention.

Referring to FIGS. from 1 through 4, a sports bag is shown comprised of a soft bag body 10, a rigid base frame 20, and two symmetrical rigid top shells 30 and 31.

The soft bag body 10 is made from soft material (cloth or leather), having a zipper 11 disposed in the front side and vertically extended between the top and bottom openings 13, and a carrying handle 12 in the front side. The rigid base frame 20 is molded from rigid plastics (for example, ABS) and shaped like a basket for holding the soft bag body 10, having a reinforced back 21, two vertical sidewalls 22, and two rollers 23 respectively fastened pivotally with the two rear corners of the bottom thereof. The periphery of the bottom opening of the soft bag body 10 is fixedly fastened to the vertical sidewalls 22 of the base frame 20 with stitches L. The two symmetrical top shells 30 and 31 are molded from rigid plastics (for example, ABS) and respectively fixedly fastened to the periphery of the top opening of the soft bag body 10 with stitches L, each having a through hole 32 and a belt 33 inserted through the through hole 32. The belt 33 has one end (The fixed end) fixedly fastened to the inside wall of the respective top shell 30 or 31 with stitches L, and the other end (free end) extended out of the through hole 32 for fastening. The free ends of the belts 33 of the top shells 30 and 31 can be tied up to hold the top shells 30 and 31 in a closed status. A belt buckle may be installed in the free end of the belts 33 for joining the free ends of the belts 33. Further, a zipper 34 is stitched to the top shells 30 and 31, and operated to close/open the top shells 30 and 31 and the top opening of the soft bag body 10.

Figure 4:
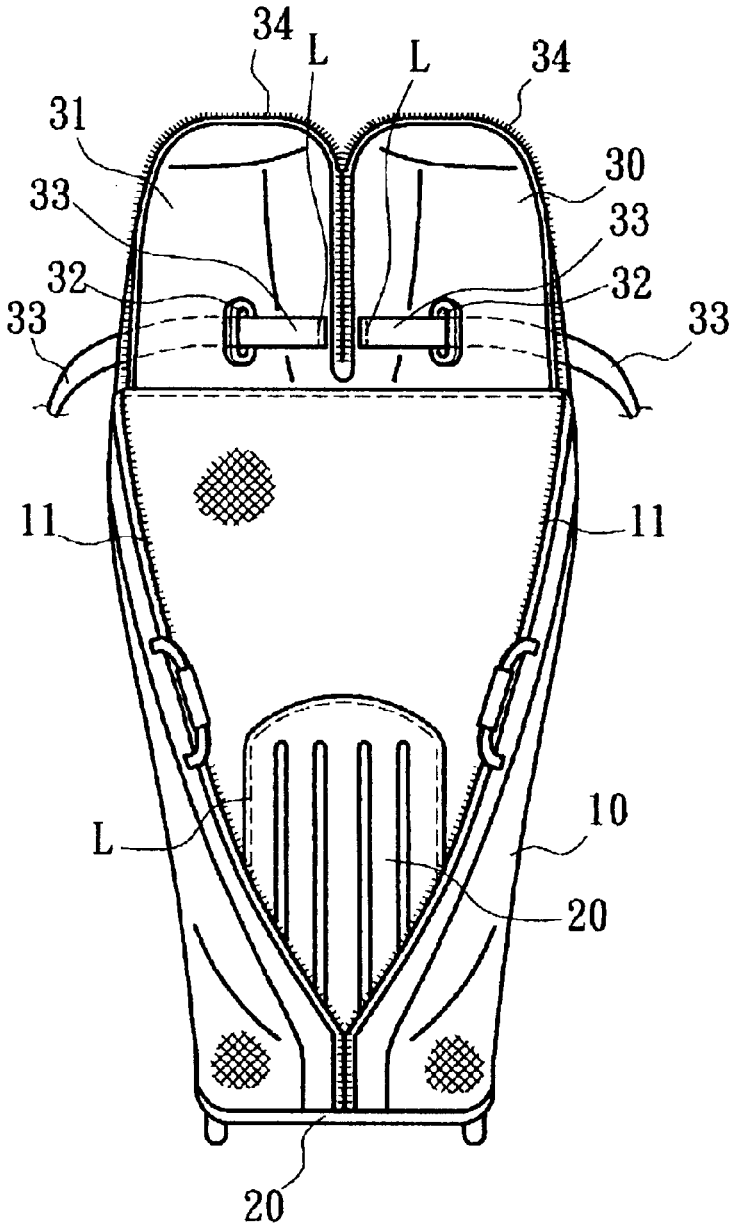
FIG. 4 illustrates the sports bag opened according to the present invention.

Referring to FIG. 4, when in use, the zippers 1 and 34 are opened, for enabling storage items, for example, golf clubs to be put into the inside of the soft bag body 10, and then the zippers 1 and 34 are closed, and then the belts 33 are fastened up to hold the storage items positively inside the soft bag body 10.

The sports bag provides numerous advantages as outlined hereinafter.

1. The rigid base frame 20 protects the bottom side of the soft bag body 10 against impact.

2. The rigid base frame 20 has a reinforced back to enhance the protection.

3. The rigid top shells 30 and 31 protect the top of the soft bag body 10 against impact.

4. The rigid base frame 20 and the rigid top shells 30 and 31 well protect the soft bag body 10 and the storage items against impact.

5. When the sports bag falling to the ground accidentally, the rigid base frame 20 or the rigid top shells 30 and 31 will touch the ground at first, preventing a severe damage to the soft bag body 10 and the storage items.

6. The belts 33 protect the zipper 34 against stretching when fastened up.

7. The rigid base frame 20 is equipped with rollers 23 so that the sports bag can easily be moved on the ground when tilted.

It is to be understood that the drawings are designed for purposes of illustration only, and are not intended as a definition of the limits and scope of the invention disclosed.

What the invention claimed is:

1. A sports bag comprising:

a rigid base frame, said base frame having a reinforced back, two vertical sidewalls, and two rollers respectively fastened pivotally with two rear corners of a bottom thereof;

a soft bag body, said soft bag body having a top opening, a bottom opening peripherally and fixedly fastened to the vertical sidewalls of said rigid base frame, a zipper longitudinally extended from said top opening and said bottom opening, and a front carrying handle; and rigid top cover means adapted to close the top opening of said soft bag body, said rigid top cover means comprising two symmetrical rigid cover shells respectively fixedly fastened to the periphery of the top opening of said soft bag body, said cover shells each having a through hole, a zipper fastened to said cover shells and adapted to close/open said cover shells and the top opening of said soft bag body, and two belts, said belts each having a fixed end fixedly fastened to the respective cover shell and a free end extended out of the through hole of the respective cover shell for fastening.

* * * * *